United States Patent [19]

Byrum, Jr.

[11] 4,090,100

[45] May 16, 1978

[54] GAS DISCHARGE DISPLAY DEVICE WITH PROTECTED DIELECTRIC

[75] Inventor: Bernard W. Byrum, Jr., Toledo, Ohio

[73] Assignee: Owens-Illinois, Inc., Toledo, Ohio

[21] Appl. No.: 560,348

[22] Filed: Mar. 21, 1975

[51] Int. Cl.[2] ..... H01J 61/30

[52] U.S. Cl. ..... 313/220; 313/174; 313/211

[58] Field of Search ..... 313/220, 188, 201, 217, 313/174

[56] References Cited

U.S. PATENT DOCUMENTS

| | | | |
|---|---|---|---|
| 3,863,089 | 1/1975 | Ernsthausen et al. | 313/220 X |
| 3,896,323 | 7/1975 | Ernsthausen | 313/220 X |
| 3,904,906 | 9/1975 | Osawa et al. | 313/220 X |
| 3,919,577 | 11/1975 | Hoehn et al. | 313/220 X |

OTHER PUBLICATIONS

Aboelfotoh, "IBM Technical Disclosure Bulletin", Mar. 1975, pp. 2953–2954.

*Primary Examiner*—Rudolph V. Rolinec
*Assistant Examiner*—Darwin R. Hostetter
*Attorney, Agent, or Firm*—Donald K. Wedding; Edward J. Holler

[57] ABSTRACT

There is disclosed a gaseous discharge display device having a plurality of gaseous discharge sites and at least one active, working dielectric surface exposed to the gas discharge at each discharge site. The active gas contacting dielectric surface is coated with a protective film in an amount sufficient to prevent the formation of undesirable contaminants on the active dielectric surface, particularly during the manufacture of the device. After the complete assembly and gas filling of the device, the protective film is removed from the vicinity of each gas discharge site by the application of a gas discharge voltage at the site sufficient to sputter the protective film away from the discharge site without sputtering the active dielectric surface.

20 Claims, 6 Drawing Figures

GAS DISCHARGE DISPLAY DEVICE WITH PROTECTED DIELECTRIC

BACKGROUND OF THE INVENTION

This invention relates to the manufacture of gas discharge devices, especially A.C. (alternating current) multiple gas discharge display/memory devices which have an electrical memory and which are capable of producing a visual display or representation of data such as numerals, letters, radar displays, aircraft displays, binary words, educational displays, etc.

Multiple gas discharge display and/or memory panels of one particular type with which the present invention is concerned are characterized by an ionizable gaseous medium, usually a mixture of at least two gases at an appropriate gas pressure, in a thin gas chamber or space between a pair of opposed dielectric charge storage members which are backed by conductor (electrode) members, the conductor members backing each dielectric member typically being appropriately oriented so as to define a plurality of discrete gas discharge units or cells.

In some prior art panels the discharge cells are additionally defined by surrounding or confining physical structure such as apertures in perforated glass plates and the like so as to be physically isolated relative to other cells. In either case, with or without the confining physical structure, charges (electrons, ions) produced upon ionization of the gas volume of a selected discharge cell, when proper alternating operating potentials are applied to selected conductors thereof, are collected upon the surfaces of the dielectric at specifically defined locations and constitute an electrical field opposing the electrical field which created them so as to terminate the discharge for the remainder of the half cycle and aid in the initiation of a discharge on a succeeding opposite half cycle of applied voltage, such charges as are stored constituting an electrical memory.

Thus, the dielectric layers prevent the passage of substantial conductive current from the conductor members to the gaseous medium and also serve as collecting surfaces for ionized gaseous medium charges (electrons, ions) during the alternate half cycles of the A.C. operating potentials, such charges collecting first on one elemental or discrete dielectric surface area and then on an opposing elemental or discrete dielectric surface area on alternate half cycles to constitute an electrical memory.

An example of a panel structure containing non-physically isolated or open discharge cells is disclosed in U.S. Pat. No. 3,499,167 (incorporated herein by reference) issued to Theodore C. Baker, et al.

An example of a panel containing physically isolated cells is disclosed in the article by D. L. Bitzer and H. G. Slottow entitled "The Plasma Display Panel — A Digitally Addressable Display With Inherent Memory", Proceeding of the Fall Joint Computer Conference, IEEE, San Francisco, California, November, 1966, pages 541–547 and also in U.S. Pat. No. 3,559,190 (incorporated herein by reference).

In the construction of the panel, a continuous volume of ionizable gas is confined between a pair of dielectric surfaces backed by conductor arrays typically forming matrix elements. The two conductor arrays may be orthogonally related sets of parallel lines (but any other configuration of conductor arrays may be used). The two arrays define at their intersections a plurality of opposed pairs of charge storage areas on the surfaces of the dielectric bounding or confining the gas. Thus, for a conductor matrix having H rows and C columns the number of elemental or discrete areas will be twice the number of elemental discharge cells.

In addition, the panel may comprise a so-called monolithic structure in which the conductor arrays are created on a single substrate and wherein two or more arrays are separated from each other and from the gaseous medium by at least one insulating member. In such a device the gas discharge takes place not between two opposing elemental areas on two different substrates, but between two contiguous or adjacent elemental areas on the same substrate; the gas being confined between the substrate and an outer retaining wall.

It is also feasible to have a gas discharge device wherein some of the conductive or electrode members are in direct contact with the gaseous medium and the remaining electrode members are appropriately insulated from such gas, i.e., at least one insulated electrode.

In the prior art there exists D.C. (direct current) devices where the electrodes consist of an anode and a cathode which are typically in direct contact with the ionizable gaseous medium. It is also possible to construct such D.C. devices utilizing a dielectric, i.e. with, the same structure and configuration as an A.C. gas discharge display/memory panel described hereinbefore.

A wide variety of such devices exist in the prior art. Examples of such devices are disclosed in U.S. Pat. No. 2,142,106; 3,260,880; 3,720,452; 3,725,713; 3,237,040, and 3,497,751, all of which are incorporated herein by reference.

The present invention is intended to relate to the manufacture of all types of A.C. and D.C. display panels utilizing a dielectric surface in contact with the gas.

In addition to the matrix configuration, the conductor arrays of the display device (D.C. or A.C.) may be shaped otherwise. Accordingly, while the typical conductor arrangement is of the crossed grid type as discussed herein, it is likewise apparent that where a maximal variety of two dimensional display patterns is not necessary, as where specific standardized visual shapes (e.g., numerals, letters, words, etc.) are to be formed and image resolution is not critical, the conductors may be shaped accordingly (e.g., a segmented digit display).

THE INVENTION

In accordance with this invention, at least one non-chemically reactive, chemically inert, protective film is continuously or discontinuously applied to the active surface of the dielectric body of a gas discharge panel having at least one gas discharge site, the film being applied at each gas discharge site in an amount sufficient to prevent the formation of contaminants on the active dielectric surface and stabilize the panel operating voltages relative to a panel having a nonprotected dielectric surface, the protective film subsequently being removed from the vicinity of each gas discharge site by the application of a gas discharge voltage at the site sufficient to sputter the protective film without sputtering the active dielectric surface.

A wide range of protective film materials is contemplated. A primary critereon for selection of the protective film is that the film should be non-chemically reactive and inert with respect to the active surface of the dielectric body. It is also useful for the protective film to have a lower secondary election emission (Townsend second coefficient) relative to the material used as the active surface of the dielectric body. The protective film should preferably have a higher sputtering rate and a lower sputtering threshold relative to that of the active or working dielectric surface such that the sputtering process will automatically and spontaneously cease when all of the protective film at the discharge site has been removed, typically by sputtering, and the active dielectric surface is exposed.

Sputtering is a function of the heat of sublimation of the material. Sputtering is defined as the process of atomic or molecular displacement or ejection during bombardment by energetic ions, plasma discharge, etc.

In addition, the protective film may be selectively removed from gas discharge sites by any process whereby molecular and/or atomic size particules are disintegrated, evaporated, or otherwise removed from the dielectric and transferred to a non-gas discharge location. Such processes would include laser beam and RF induced sputtering.

In the practice of this invention, inorganic materials, especially oxides, are generally selected as protective films. Organic materials may be disadvantageous because of the tendency of organic materials to decompose at relatively moderate temperatures and form potentially undesirable carbonaceous residues, including gaseous products such as CO, $CO_2$, $H_2$, and $O_2$, which could interfere with optimum panel operating performance.

Typical inorganic protective films include lead oxide, bismuth oxide, antimony oxide, cadmium oxide, iron oxide, germanium oxide, arsenic oxide, silicon oxide, copper oxide, silver oxide, manganese oxide, tin oxide, vanadium oxide, nickel oxide, and cobalt oxide. Non-oxide films, such as halides (especially fluorides) of such elements (lead halide, etc.) may also be used. Sulfides, tellurides and selenides are also contemplated. Multiple protective films may also be applied. In one best embodiment, the protective film is lead oxide.

The protective film thickness is sufficient to prevent the formation of contaminants on the active dielectric surface, such as hydroxides formed on the active surface in the presence of air and water vapor when each panel sub-assembly component is being processed in an atmospheric environment. Other contamination may also develop from the reaction of carbon monoxide or carbon dioxide with the active surface. It has been discovered that the pressence of such contaminants cause the panel voltages to be unstable. Typically the film has an average thickness of at least about 50 angstrom units, preferrably at least about 100 angstrom units, with a range of about 50 to 1000 angstrom units.

The term "film" as used herein is intended to be all inclusive of other related terms such as layer, deposit, sheet, coating, surface skin, membranous covering, and so forth.

The protective film is applied by any suitable thin-film process such as sputtering target techniques, ion plating, electron beam evaporation, plasma spraying, flame spraying, arc spraying, vapor deposition, and vacuum deposition. In one best embodiment, vacuum deposition is used. Combinations of such processes may also be used. Such processes are all well known in the art. The film may be applied continuously over all of the active dielectric surface or discontinuously over the dielectric surface at each gas discharge site.

After the panel has been assembled by the sealing of at least two dielectric bodies face to face separated by an ionizable gaseous layer, as described both hereinbefore and hereinafter, the protective film is removed from each gas discharge site by the application of a voltage across the gas discharge site. The required voltage will be a function of the protective material, the geometric shape of the voltage pulse, the width and frequency of the voltage pulse, and the time of voltage application. In one best embodiment hereof, the voltage is of a so-called square wave shape.

The active layer may be any suitable material which has been disclosed in the prior art. Examples include aluminum oxide, silicon oxide, lead oxide, magnesium oxide, cesium oxide, rare earth oxides (elements 21, 39, 57 through 71, and 89 through 103), beryllium oxide, calcium oxide, barium oxide, strontium oxide, radium oxide, titanium oxide, zirconium oxide, hafnium oxide, transition metal oxides, and so forth. Non-oxide materials such as halides, sulfides, tellurides and selenides may also be used. If a particular material is selected as the active layer, the protective film should be of a different material. There are instances when the same material may be used for both layers; however, the sputtering away of the protective film (or a portion thereof) must then be under more controlled conditions.

One or more sub-layers may also exist under the active dielectric surface, as is widely disclosed in the prior art. Reference is made to U.S. Pat. Nos. 3,863,089 (Ernsthausen and Byrum, Jr.); 3,852,607 (Hoehn and Ernsthausen; 3,863,089 (Ernsthausen and Byrum, Jr.); 3,823,394 (Byrum, Jr. and Ernsthausen); 3,836,393 (Ernsthausen and Emch); 3,634,719 (Ernsthausen); and 3,716,742 (Nakayama), all of which are incorporated herein by reference.

The active or working dielectric layer including any dielectric sub-layers or base dielectric layer is applied by any suitable thin-film process, for example as disclosed hereinbefore.

Likewise, thick-film processes such as silk screening may be utilized, especially in the application of a base dielectric material as disclosed in the Baker et al patent and the dielectric patents, all noted hereinbefore.

In one best embodiment hereof, the active dielectric layer (including sub-layers) and the protective film are applied in sequential or consecutive steps using a thin-film process, i.e. the active layer is first applied and then the protective film is immediately applied over the active layer. This is a so-called common-time of application process.

After the protective film has been sputtered from each gas discharge site, there will typically result a valley of active surface dielectric material surrounded by a ridge of the protective film material. Where the active surface is of a high election yield material (i.e. high Townsend's (gamma) second coefficient) relative to the surrounding protective film, there will result a dielectric surface condition akin to that disclosed in U.S. Pat. No. 3,823,394.

In one best specific embodiment contemplated in the practice of this invention, lead oxide is applied as protective film over a magnesium oxide working dielectric surface. The lead oxide has a thickness of about 100 angstrom units. The lead oxide is removed from panel gas discharge sites by the application of a preliminary operating voltage of at least about 160 volts for at least about 8 hours. The higher the voltage, the shorter the time required for removal. The voltage has a square wave shape and a frequency of 50 kilohertz.

As used herein, the term "contaminant" is intended to include any undesirable substance foreign to the surface of the dielectric which would interfere with the efficient and effective operation of the device. The definition comprises oxides, non-oxides, absorbates, and numerous other undesirable chemical and physical materials. Specific examples include hydroxides, carbonates, and other inorganic compounds; also carboneous or organic residues.

In a further embodiment of this invention, a reactive gas gettering substance is applied (continuously or discontinuously) as a film or deposit at or near discharge sites. This gettering material is preferably beneath the protective film out of gas contact so as to prevent getter contamination. The gettering material is subsequently exposed to the ionizable gas when the protective film is sputtered and removed from the discharge sites. During the continued operation of the device, getter material will be sputtered and relocated at interstitial loci (between discharge sites) on the surface of the protective film in contact with the ionizable gas.

In a further embodiment the getter is initially applied to the gas contact surface of the protective film. In still another embodiment the protective film serves as the getter.

The reactive gas gettering substance is useful for cleaning of the ionizable gas after the final assembly of the gas display device. This is especially beneficial and important since contaminants are sometimes introduced during the gas filling of the device. Reactive gas gettering materials are well known in the prior art. Examples include non-conductive or insulating materials as well as conductive materials. When conductive materials are utilized, such are applied to the protective layer as insulated spots or islands.

Getter layers of an oxide nature for surfaces which must remain insulative are best selected from member oxides of the same chemical group of the Periodic Table as the active layer to be protected (i.e. BaO for MgO). A getter effect may also be produced by sputtering a portion of the active layer itself.

The getter material and the protection layer may be one and the same. In such an embodiment, the sputtering process produces fresh material at non-discharge sites which acts as a getter.

In another particular embodiment, the active layer, getter layer and protection layer are all one material with the contaminated outer layer being removed by the sputtering process, with fresh material exposed and sputtered to non-discharge sites to act as a getter while exposing the active layer at discharge sites.

If non-insulative getters are used, i.e. in a D.C. device, then common metal getters such as Ti, Ba, Zn, rare earth metals, etc. are useable. In general, the corresponding oxides may also be useful.

THE DRAWINGS

The drawings are presented to illustrate some of the best embodiments contemplated by the inventor in the practice of this invention.

FIG. 1 is a plot of experimental comparative data illustrating one of the advantages of this invention.

FIGS. 2, 3, 4, and 5 illustrate a gas discharge display/memory panel of the Baker et al. type as disclosed in U.S. Pat. No. 3,559,190.

Figure 1:
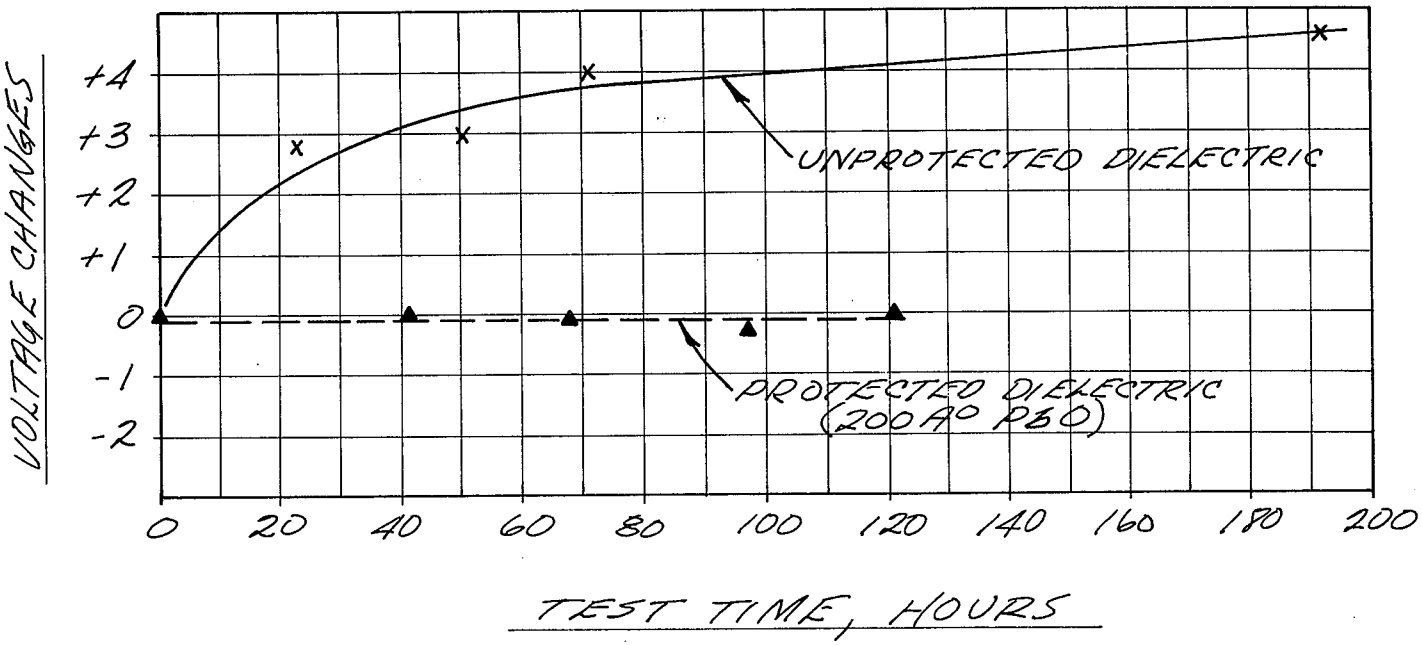
Figure 3:
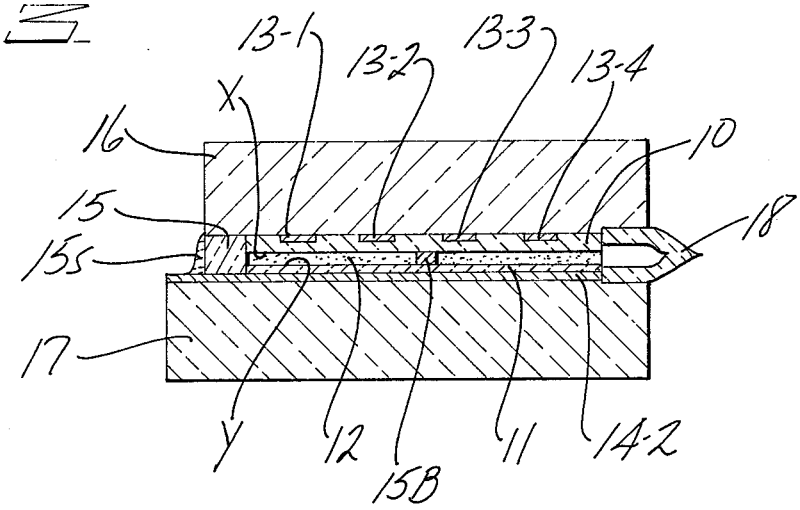
FIG. 3 is a cross-sectional view (enlarged, but not to proportional scale since the thickness of the gas volume, dielectric members and conductor arrays have been enlarged for purposes of illustration) taken on lines 2 — 2 of FIG. 2.
Figure 2:
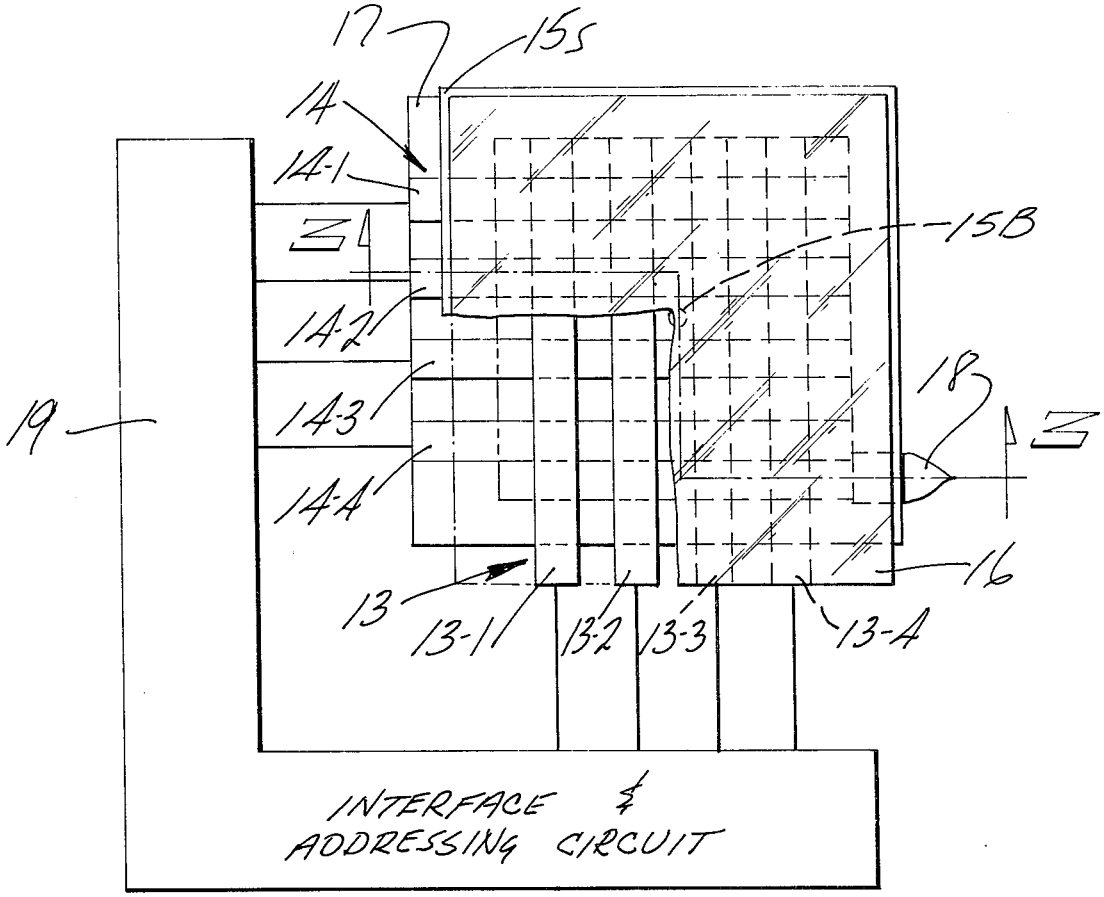
FIG. 2 is a partially cut-away plan view of a gaseous discharge display-memory panel as connected to a diagrmmatrically illustrated source of operating potentials.

In FIG. 1 there is illustrated two plots of the change in panel sustaining voltage versus panel test (or operating) time in hours. One plot (lower curve in FIG. 1) represents a panel of the Baker et al type) having the opposing dielectric ytterbium oxide active surfaces coated with 200 angstrom units of a lead oxide protective film. This curve shows that the change in panel sustaining voltage is substantially zero for over 120 hours of panel operation. The other plot (upper curve in FIG. 1) represents a Baker et al panel having opposing ytterbium oxide dielectric active surfaces which are not protected. This curve shows that the change in the panel sustaining voltage is over +4 volts for over 120 hours of panel operation.

As illustrated in FIGS. 2 to 5, the Baker et al. device utilizes a pair of dielectric films 10 and 11 separated by a thin layer or volume of a gaseous discharge medium 12, and medium 12 producing a copious supply of charges (ions and electrons) which are alternately collectable on the surfaces of the dielectric members at opposed or facing elemental or discrete areas X and Y defined by the conductor matrix on non-gas-contacting sides of the dielectric members, each dielectric member presenting large open surface areas and a plurality of pairs of elemental X and Y areas. While the electrically operative structural members such as the dielectric members 10 and 11 and conductor matrixes 13 and 14 are all relatively thin (being exaggerated in thickness in the drawings) they are formed on and supported by rigid nonconductive support members 16 and 17 respectively.

Preferably, one or both of nonconductive support members 16 and 17 pass light produced by discharge in the elemental gas volumes. Preferably, they are transparent glass members and these members essentially define the overall thickness and strength of the panel. For example, the thickness of gas layer 12 as determined by spacer 15 is usually under 10 mils and preferably about 4 to 8 mils, dielectric layers 10 and 11 (over the conductors at the elemental or discrete X and Y areas) are usually between 1 and 2 mils thick, and conductors 13 and 14 about 8,000 angstroms thick. However, support members 16 and 17 are much thicker (particularly in larger panels) so as to provide as much ruggedness as may be desired to compensate for stresses in the panel. Support mmbers 16 and 17 also serve as heat sinks for heat generated by discharges and thus minimize the effect of temperature on operation of the device. If it is desired that only the memory function be utilized, then none of the members need be transparent to light.

Except for being nonconductive or good insulators the electrical properties of support members 16 and 17 are not critical. The main function of support members 16 and 17 is to provide mechanical support and strength for the entire panel, particularly with respect to pressure differential acting on the panel and thermal shock. As noted earlier, they should have thermal expansion characteristics substantially matching the thermal expansion characteristics of dielectric layers 10 and 11. Ordinary ¼ inch commercial grade soda lime plate glasses have been used for this purpose. Other glasses such as low expansion glasses or transparent devitrified glasses can be used provided they can withstand processing and have expansion characteristics substantially matching expansion characteristics of the dielectric coatings 10 and 11. For given pressure differentials and thickness of plates, the stress and deflection of plates may be determined by following standard stress and strain formulas (see R. J. Roark, *Formulas for Stress and Strain,* McGraw-Hill, 1954).

Spacer 15 may be made of the same glass material as dielectric films 10 and 11 and may be an integral rib formed on one of the dielectric members and fused to the other members to form a bakeable hermetic seal enclosing and confining the ionizable gas volume 12. However, a separate final hermetic seal may be effected by a high strength devitrified glass sealant 15S. Tubulation 18 is provided for exhausting the space between dielectric members 10 and 11 and filling that space with the volume of ionizable gas. For large panels small beadlike solder glass spacers such as shown at 15B may be located between conductor intersections and fused to dielectric members 10 and 11 to aid in withstanding stress on the panel and maintain uniformity of thickness of gas volume 12.

Conductor arrays 13 and 14 may be formed on support members 16 and 17 by a number of well-known processes, such as photoetching, vacuum deposition, stencil screening, etc. In the panel shown in FIG. 5, the center-to-center spacing of conductors in the respective arrays is about 17 mils. Transparent or semi-transparent conductive material such as tin oxide, gold, or aluminum can be used to form the conductor arrays and should have a resistance less than 3000 ohms per line. Narrow opaque electrodes may alternately be used so that discharge light passes around the edges of the electrodes to the viewer. It is important to select a conductor material that is not attacked during processing by the dielectric material.

It will be appreciated that conductor arrays 13 and 14 may be wires or filaments of copper, gold, silver or aluminum or any other conductive metal or material. For example 1 mil wire filaments are commercially available and may be used in the invention. However, formed in situ conductor arrays are preferred since they may be more easily and uniformly placed on and adhered to the support plates 16 and 17.

Dielectric layer members 10 and 11 are formed of an inorganic material and are preferably formed in situ as an adherent film or coating which is not chemically or physically affected during bake-out of the panel. One such material is a solder glass such as Kimble SG-68 manufactured by and commercially available from the assignee of the present invention.

This glass has thermal expansion characteristics substantially matching the thermal expansion characteristics of certain soda-lime glasses, and can be used as the dielectric layer when the support members 16 and 17 are soda-lime glass plates. Dielectric layers 10 and 11 must be smooth and have a dielectric breakdown voltage of about 1000 v. and be electrically homogeneous on a microscopic scale (e.g., no cracks, bubbles, crystals, dirt, surface films, etc.). In addition, the surfaces of dielectric layers 10 and 11 should be good photoemitters of electrons in a baked out condition. Alternatively, dielectric layers 10 and 11 may be overcoated with materials designed to produce good electron emission, as in U.S. Pat. No. 3,634,719, issued to Roger E. Ernsthausen. Of course, for an optical display at least one of dielectric layers 10 and 11 should pass light generated on discharge and be transparent or translucent and, preferably, both layers are optically transparent.

The preferred spacing between surfaces of the dielectic films is about 4 to 8 mils with conductor arrays 13 and 14 having center-to-center spacing of about 17 mils.

The ends of conductors 14-1 . . . 14-4 and support member 17 extend beyond the enclosed gas volume 12 and are exposed for the purpose of making electrical connection to interface and addressing circuitry 19. Likewise, the ends of conductors 13-1 . . . 13-4 on support member 16 extend beyond the enclosed gas volume 12 and are exposed for the purpose of making electrical connection to interface and addressing circuitry 19.

As in known display systems, the interface and addressing circuitry or system 19 may be relatively inexpensive line scan systems or the somewhat more expensive high speed random access systems. In either case, it is to be noted that a lower amplitude of operating potentials helps to reduce problems associated with the interface circuitry between the addressing system and the display/memory panel, per se. Thus, by providing a panel having greater uniformity in the discharge characteristics throughout the panel, tolerances and operating characteristics of the panel with which the inferfacing circuitry cooperate, are made less rigid.

One mode of initiating operation of the panel will be described with reference to FIG. 4, which illustrates the condition of one elemental gas volume 30 having an elemental cross-sectional area and volume which is quite small relative to the entire volume and cross-sectional area of gas 12. The cross-sectional area of volume 30 is defined by the overlapping common elemental areas of the conductor arrays and the volume is equal to the product of the distance between the dielectric surfaces and the elemental area. It is apparent that if the conductor arrays are uniform and linear and are orthogonally (at right angles to each other) related each of elemental areas X and Y will be squares and if conductors of one conductor array are wider than conductors of the other conductor arrays, said areas will be rectangles. If the conductor arrays are at transverse angles relative to each other, other than 90°, the areas will be diamond shaped so that the cross-sectional shape of each volume is determined solely in the first instance by the shape of the common area of overlap between conductors in the conductor arrays 13 and 14. The dotted lines 30' are imaginary lines to show a boundary of one elemental volume about the center of which each elemental discharge takes place. As described earlier herein, it is known that the cross-sectional area of the discharge in a gas is affected by, inter alia, the pressure of the gas, such that, if desired, the discharge may even be constricted to within an area smaller than the area of conductor overlap. By utilization of this phenomena, the light production may be confined or resolved substantially to the area of the elemental cross-sectional area defined by conductor overlap. Moreover, by operating at such pressure charges (ions and electrons) produced on discharge are laterally confined so as to not materially affect operation of adjacent elemental discharge volumes.

Figure 4:
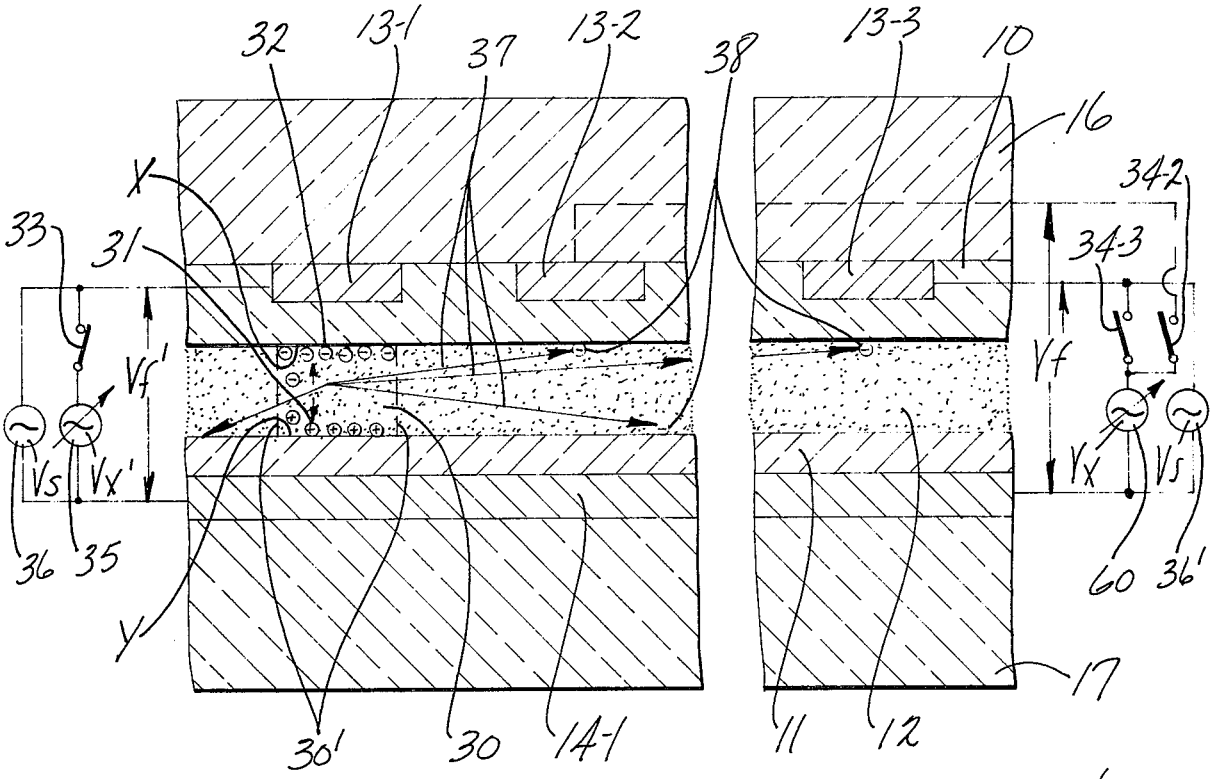
FIG. 4 is an explanatory partial cross-sectional view similar to FIG. 3 (enlarged, but not to proportional scale).

In the instant shown in FIG. 4, a conditioning discharge about the center of elemental volume 30 has been initiated by application to conductor 13-1 and conductor 14-1 firing potential $V_x'$ as derived from a source 35 of variable phase, for example, and source 36 of sustaining potential $V_s$ (which may be a sine wave, for example). The potential $V_x'$ is added to the sustaining potential $V_s$ as sustaining potential $V_s$ increases in magnitude to initiate the conditioning discharge about the center of elemental volume 30 shown in FIG. 4. There, the phase of the source 35 of potential $V_x'$ has been adjusted into adding relation to the alternating voltage from the source 36 of sustaining voltage $V_s$ to provide a voltage $V_f'$, when switch 33 has been closed, to conductors 13-1 and 14-1 defining elementary gas volume 30 sufficient (in time and/or magnitude) to produce a light generating discharge centered about discrete elemental gas volume 30. At the instant shown, since conductor 13-1 is positive, electrons 32 have collected on and are moving to an elemental area of dielectric member 10 substantially corresponding to the area of elemental gas volume 30 and the less mobile positive ions 31 are beginning to collect on the opposed elemental area of dielectric member 11 since it is negative. As these charges build up, they constitute a back voltage opposed to the voltage applied to conductors 13-1 and 14-1 and serve to terminate the discharge in elemental gas volume 30 for the remainder of a half cycle.

During the discharge about the center of elemental gas volume 30, photons are produced which are free to move or pass through gas medium 12, as indicated by arrows 37, to strike or impact remote surface areas of photoemissive dielectric members 10 and 11, causing such remote areas to release electrons 38. Electrons 38 are, in effect, free electrons in gas medium 12 and condition each other discrete elemental gas volume for operation at a lower firing potential $V_f$ which is lower in magnitude than the firing potential $V_f'$ for the initial discharge about the center of elemental volume 30 and this voltage is substantially uniform for each other elemental gas volume.

Thus, elimination of physical obstructions or barriers between discrete elemental volumes, permits photons to travel via the space occupied by the gas medium 12 to impact remote surface areas of dielectric members 10 and 11 and provides a mechanism for supplying free electrons to all elemental gas volumes, thereby conditioning all discrete elemental gas volumes for subsequent discharges, respectively, at a uniform lower applied potential. While in FIG. 4 a single elemental volume 30 is shown, it will be appreciated that an entire row (or column) of elemental gas volumes may be maintained in a "fired" condition during normal operation of the device with the light produced thereby being masked or blocked off from the normal viewing area and not used for display purposes. It can be expected that in some applications there will always be at least one elemental volume in a "fired" condition and producing light in a panel, and in such applications it is not necessary to provide separate discharge or generation of photons for purposes described earlier.

However, as described earlier, the entire gas volume can be conditioned for operation at uniform firing potentials by use of external or internal radiation so that there will be no need for a separate source of higher potential for initiating an initial discharge. Thus, by radiating the panel with ultraviolet radiation or by inclusion of a radioactive material within the glass material or gas space, all discharge volumes can be operated at uniform potentials from addressing and interface circuit 19.

Since each discharge is terminated upon a build up or storage of charges at opposed pairs of elemental areas, the light produced is likewise terminated. In fact, light production lasts for only a small fraction of a half cycle of applied alternating potential and depending on design parameters, is in the nanosecond range.

After the initial firing or discharge of discrete elemental gas volume 30 by a firing potential $V_f'$, switch 33 may be opened so that only the sustaining voltage $V_s$ from source 36 is applied to conductors 13-1 and 14-1. Due to the storage of charges (e.g., the memory) at the opposed elemental areas X and Y, the elemental gas volume 30 will discharge again at or near the peak of negative half cycles of sustaining voltage $V_s$ to again produce a momentary pulse of light. At this time, due to reversal of field direction, electrons 32 will collect on and be stored on elemental surface area Y of dielectric member 11 and positive ions 31 will collect and be stored on elemental surface area X of dielectric member 10. After a few cycles of sustaining voltage $V_s$, the times of discharges become symmetrically located with respect to the wave form of sustaining voltage $V_s$. At remote elemental volumes, as for example, the elemental volumes defined by conductor 14-1 with conductors 13-2 and 13-3, a uniform magnitude or potential $V_x$ from source 60 is selectively added by one or both of switches 34-2 or 34-3 to the sustaining voltage $V_s$, shown as 36', to fire one or both of these elemental discharge volumes. Due to the presence of free electrons produced as a result of the discharge centered about elemental volume 30, each of these remote discrete elemental volumes have been conditioned for operation at uniform firing potential $V_f$.

In order to turn "off" an elemental gas volume (i.e., terminate a sequence of discharge representing the "on" state), the sustaining voltage may be removed. However, since this would also turn "off" other elemental volumes along a row or column, it is preferred that the volumes be selectively turned "off" by application to selected "on" elemental volumes a voltage which can neutralize the charges stored at the pairs of opposed elemental areas.

This can be accomplished in a number of ways, as for example, varying the phase or time position of the potential from source 60 to where that voltage combined with the potential form source 36' falls substantially below the sustaining voltage.

It is apparent that the plates 16–17 need not be flat but may be curved, curvature of facing surfaces of each plate being complementary to each other. While the preferred conductor arrangement is of the crossed grid type as shown herein, it is likewise apparent that where an infinite variety of two dimensional display patterns are not necessary, as where specific standardized visual shapes (e.g., numerals, letters, words, etc.) are to be formed and image resolution is not critical, the conductors may be shaped accordingly.

Figure 5:
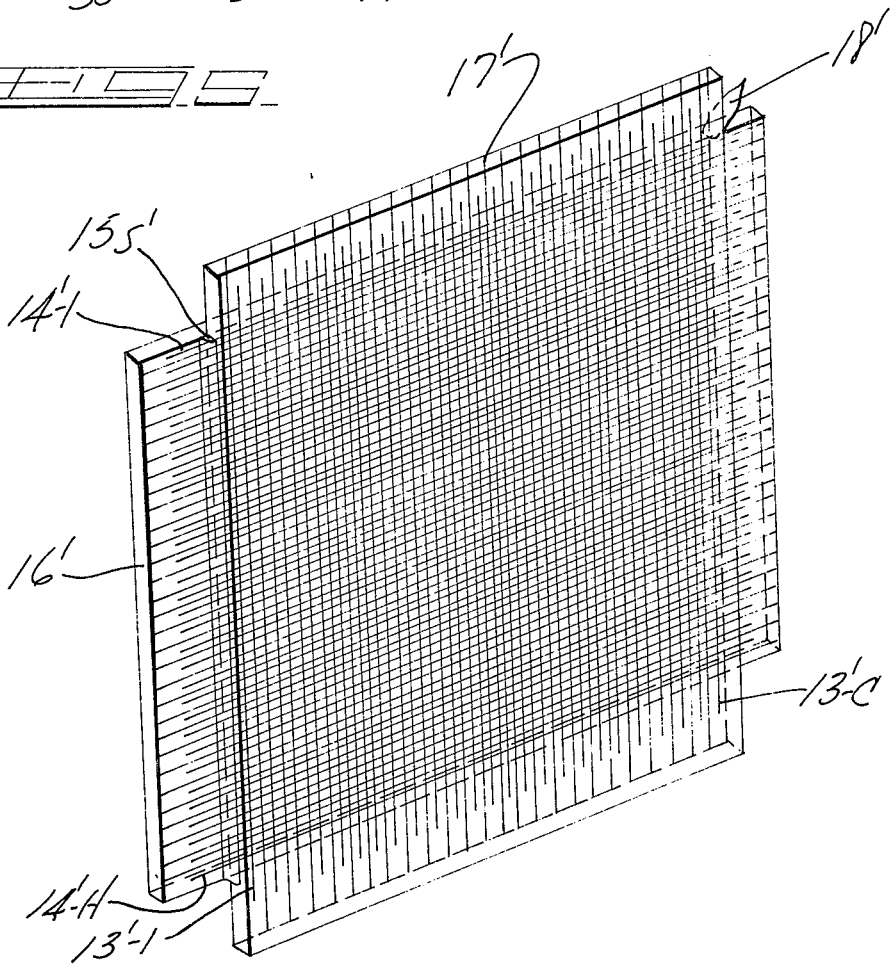
FIG. 5 is an isometric view of a gaseous discharge display-memory panel.

The device shown in FIG. 5 is a panel having a large number of elemental volumes similar to elemental volume 30 (FIG. 4). In this case more room is provided to make electrical connection to the conductor arrays 13' and 14', respectively, by extending the surfaces of support members 16' and 17' beyond seal 15S', alternate conductors being extended on alternate sides. Conductor arrays 13' and 14' as well as support members 16' and 17' are transparent. The dielectric coatings are not shown in FIG. 5 but are likewise transparent so that the panel may be viewed from either side.

The support members, dielectric member, and dielectric coatings on one side or half of the panel may be dark and/or opaque in order to improve the viewing light contrast on the opposite side of the panel. Reference is made to U.S. Pat. No. 3,686,686, incorporated herein by reference.

Figure 6:
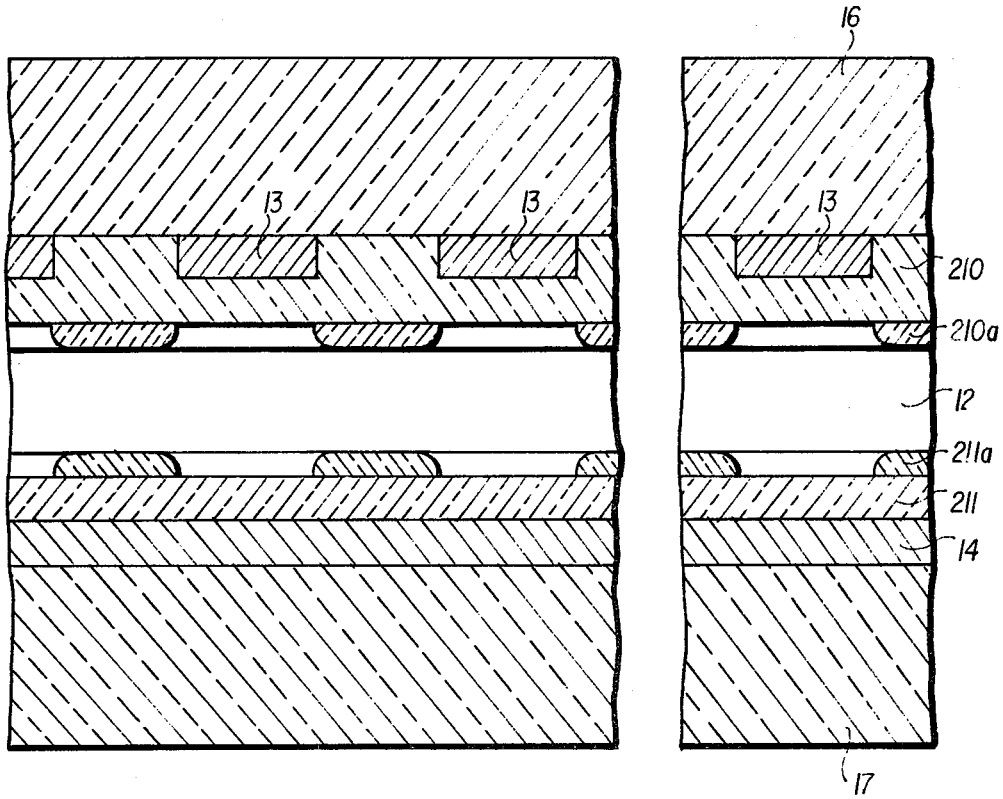
FIG. 6 is a cross-sectional view illustrating the protective film in one embodiment of the invention.

In FIG. 6 there is illustrated substrates 16 and 17, electrodes 13 and 14, dielectric members 210 and 211, gaseous medium 12, and dielectric protective overcoats **210*a* and 211*a*. At each gas discharge site a valley of active surface dielectric material 210 and 211 is surrounded by the protective overcoat material 210*a* and 211*a***.

Although not illustrated in FIG. 6, additional dielectric undercoats may be used below the protective overcoats **210*a* and 211*a***. Reference is made to Ernsthausen, Byrum Jr., and other dielectric patents previously referred to hereinfore.

A wide variety of gases and gas mixtures have been utilized as the gaseous medium in a gas discharge device. Typical of such gases include CO; $CO_2$; halogens, nitrogen; $NH_3$; oxygen; water vapor; hydrogen; hydrocarbons; $P_2O_5$; boron fluoride, acid fumes; $TiCl_4$; air; $H_2O_2$; vapors of sodium, mercury thallium, cadmium, rubidium, and cesium; carbon disulfide; $H_2S$; deoxygenated air; phosphorus vapors; $C_2H_2$; $CH_4$; naphthalene vapor; anthracene; freon, ethyl alcohol; methylene bromide; heavy hydrogen; electron attaching gases; sufur hexafluoride; tritium; radioactive gases; and the rare or inert Group VIII gases.

I claim:

1. As an article of manufacture, a gaseous discharge device comprising an ionizable gaseous medium, opposing arrays of conductors spaced from each other on opposite sides of said gaseous medium and which define a plurality of gaseous discharge sites within the ionizable gaseous medium, one at each cross-point between pairs of conductors, one from each array, at least one dielectric body between at least one array of conductors and the gaseous medium to insulate the array of conductors from the gaseous medium, and a protective film on only portions of the surface of said dielectric body facing said gaseous medium between said gaseous discharge sites to isolate said portions of the dielectric body from the gaseous medium, said protective film being excluded from said surface of said dielectric body at said discharge sites, whereby a valley of the active surface of the dielectric body is in contact with the gaseous medium at each discharge site and said valley is surrounded by a ridge of said protective film.

2. The invention of claim 1 wherein said protective film has a higher sputtering rate and a lower sputtering threshold relative to that of said active dielectric surface.

3. The invention of claim 1 wherein the active dielectric surface consists essentially of at least one oxide member selected from the group consisting of magnesium oxide, rare earth oxides, and cesium oxide.

4. The invention of claim 3 wherein the protective film consists essentially of an oxide material.

5. The invention of claim 4 wherein said oxide material is selected from the group consisting of lead oxide, bismuth oxide, antimony oxide, cadmium oxide, iron oxide, germanium oxide, arsenic oxide, silicon oxide, copper oxide, silver oxide, manganese oxide, tin oxide, vanadium oxide, nickel oxide and cobalt oxide.

6. The invention of claim 1 wherein the protective film has a thickness of at least about 50 angstrom units.

7. The invention of claim 1 wherein the protective film has a thickness ranging from about 50 angstrom units to about 1000 angstrom units.

8. The invention of claim 1 wherein there is at least one reactive gas gettering substance beneath the protective film out of contact with the ionizable gas.

9. As an article of manufacture a gaseous discharge device comprising an ionizable gaseous medium contained in a sealed gas chamber formed by a pair of opposed dielectric members, each of said opposed dielectric members including an active dielectric surface on the gaseous side thereof and being backed by electrode members, the electrode members behind one of said dielectric members being transversely oriented with respect to the electrode members behind the other opposing dielectric member so as to define a plurality of discharge sites, and a protective film on only portions of said active dielectric surface between said gaseous discharge sites to isolate said portions of said active dielectric surfaces from said gaseous medium, said protective film being excluded from said active dielectric surfaces at said discharge sites, whereby a valley of said active dielectric surface at each discharge site is in contact with the gaseous medium and said valley is surrounded by a ridge of said protective film.

10. The invention of claim 9 wherein said protective film is non-chemically reactive and inert with respect to said active dielectric surface.

11. The invention of claim 9 wherein said protective film has a lower secondary electron emission relative to the material of said active dielectric surface.

12. The invention of claim 9 wherein said protective film has a higher sputtering rate and a lower sputtering threshold relative to that of said active dielectric surface.

13. The invention of claim 9 wherein the active dielectric surface consists essentially of at least one oxide member selected from the group consisting of magnesium oxide, rare earth oxides, and cesium oxide.

14. The invention of claim 13 wherein the protective film consists essentially of an oxide material.

15. The invention of claim 14 wherein said oxide material is selected from the group consisting of lead oxide, bismuth oxide, antimony oxide, cadmium oxide, iron oxide, germanium oxide, arsenic oxide, silicon oxide, copper oxide, silver oxide, manganese oxide, tin oxide, vanadium oxide, nickel oxide and cobalt oxide.

16. The invention of claim 9 wherein the protective film consists essentially of a non-oxide material.

17. The invention of claim 9 wherein the protective film has a thickness of at least about 50 angstrom units.

18. The invention of claim 9 wherein the protective film has a thickness ranging from about 50 angstrom units to about 1000 angstrom units.

19. The invention of claim 9 wherein there is at least one reactive gas gettering substance beneath the protective film out of contact with the ionizable gas.

20. The invention of claim 1 wherein said protective film has a lower secondary electron emission relative to the material of said active dielectric surface.

* * * * *